US006830328B2

(12) United States Patent
Cuyler, Jr.

(10) Patent No.: US 6,830,328 B2
(45) Date of Patent: Dec. 14, 2004

(54) COMBINATION INPUT AND OUTPUT TRAY ASSEMBLY FOR A PRINTING DEVICE

(75) Inventor: Benjamin Cuyler, Jr., Willingboro, NJ (US)

(73) Assignee: Oki Data Americas, Inc., Mt. Laurel, NJ (US)

( * ) Notice: Subject to any disclaimer, the term of this patent is extended or adjusted under 35 U.S.C. 154(b) by 18 days.

(21) Appl. No.: 10/288,635

(22) Filed: Nov. 5, 2002

(65) Prior Publication Data

US 2004/0085426 A1 May 6, 2004

(51) Int. Cl.[7] ..... B41J 2/01
(52) U.S. Cl. ..... 347/104; 347/101
(58) Field of Search ..... 347/104, 101; 400/646, 647, 647.1; 399/384, 405, 393; 271/207, 213, 3.14

(56) References Cited

U.S. PATENT DOCUMENTS 1,383,032 A 6/1921 Scranton
3,870,295 A * 3/1975 Kukucka ..... 271/290
3,908,810 A 9/1975 Denley
D267,803 S 2/1983 Kalvitis
4,445,647 A 5/1984 Deeg et al.
D286,044 S 10/1986 Kando
4,651,967 A 3/1987 McCoy
D294,835 S 3/1988 Nagahiro
D344,751 S 3/1994 Keong
6,099,179 A 8/2000 Higashi et al.
6,435,641 B1 * 8/2002 Tung et al. ..... 347/16

* cited by examiner

*Primary Examiner*—Stephen D. Meier
*Assistant Examiner*—Manish Shah
(74) *Attorney, Agent, or Firm*—Akin Gump Strauss Hauer & Feld, L.L.P.

(57) ABSTRACT

A combination input and output tray assembly for supplying and receiving elongated sheets of media for use with a printing device includes a first tray generally aligned with an input port of the printing device, the first tray receiving and supporting at least one elongated sheet of media to be processed by the printing device. A second tray overlies and is connected to the first tray, the second tray being generally aligned with an output port of the printing device, so that an elongated sheet of media discharged from the output port is received on and supported by the second tray.

11 Claims, 5 Drawing Sheets

COMBINATION INPUT AND OUTPUT TRAY ASSEMBLY FOR A PRINTING DEVICE

BACKGROUND OF THE INVENTION

The present invention relates to a combination input and output tray assembly for supplying and receiving elongated sheets of media for use with a printing device.

Printing devices such as the OKI® Data C9000 printer typically have cassettes which fit within the printing device housing for storing and feeding sheets of printing media to the printing device. Such paper cassettes are generally designed to accommodate standard sizes of printing media, such as 8½" by 11", 210 mm by 297 mm (ISO A4 size), 8½" by 14" or 11" by 17". Printing devices such as the OKI® Data C9000 printer also have a secondary input port into which individual sheets of printing media may be manually fed into the printing device. The input port of the OKI® Data C9000 printer is concealed behind a door disposed in the side of the printing device. When the door is opened, the door pivots outwardly at an angle of approximately 70 degrees, forming a tray from which individual sheets of printing media may be manually fed into the input port. Many printing devices, including the OKI® Data C9000 printer, include an output tray which is typically integral to the top portion of the printing device. Such output trays typically are designed to accommodate standard sizes of printing media sheets.

Problems not solved by the prior art include how sheets of printing media which are longer than standard sizes are fed into, received from and stored by the printing device. A device which solves these problems should provide advantages over the prior art.

BRIEF SUMMARY OF THE INVENTION

Briefly stated, according to a first aspect of the invention, a combination input and output tray assembly for supplying and receiving elongated sheets of media for use with a printing device is provided. The printing device has an input port for receiving the elongaged sheets of media and also has an output port for discharging the elongated sheets of media. The combined input and output tray assembly comprises a first tray generally aligned with the input port, the first tray receiving and supporting at least one elongated sheet of media to be received into the input port in a first direction. A second tray overlies and connects to the first tray, the second tray being generally aligned with the output port, so that an elongated sheet of media discharged from the output port in a direction generally opposite to the first direction is received on and supported by the second tray. At least one structural member of the tray assembly is attached to the printing device.

According to a second aspect of the invention, a combination input and output tray for supplying elongated sheets of media to a printing device and receiving the elongated sheets of media from the printing device is provided, the printing device having an input port for receiving sheets of media, an output port for discharging the sheets of media, and an input port access door having extension members pivotally connected to the printing device. The combination input and output tray comprises a first structure forming an input tray, a second structure forming an output tray which is attached to the input tray and a third structure forming an output bridge, the output bridge being pivotally attached to the output tray. When the input port access door is in an open position, and the combined input and output tray is assembled with the printing device, a first end of the input tray is below the input port access door, a central portion of the input tray is on top of the extension members, and a first end of the output tray is attached to the printing device. The elongated sheets of media to be fed into the input port in a first direction rest upon the printing device input door and upon the central portion of the media input tray and, if of sufficient length, upon a second end of the media input tray. The elongated sheets of media being delivered from the output port in a second direction generally opposite the first direction are guided by the output bridge onto a central planar portion of the output tray and, if of sufficient length, onto a second end of the output tray.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
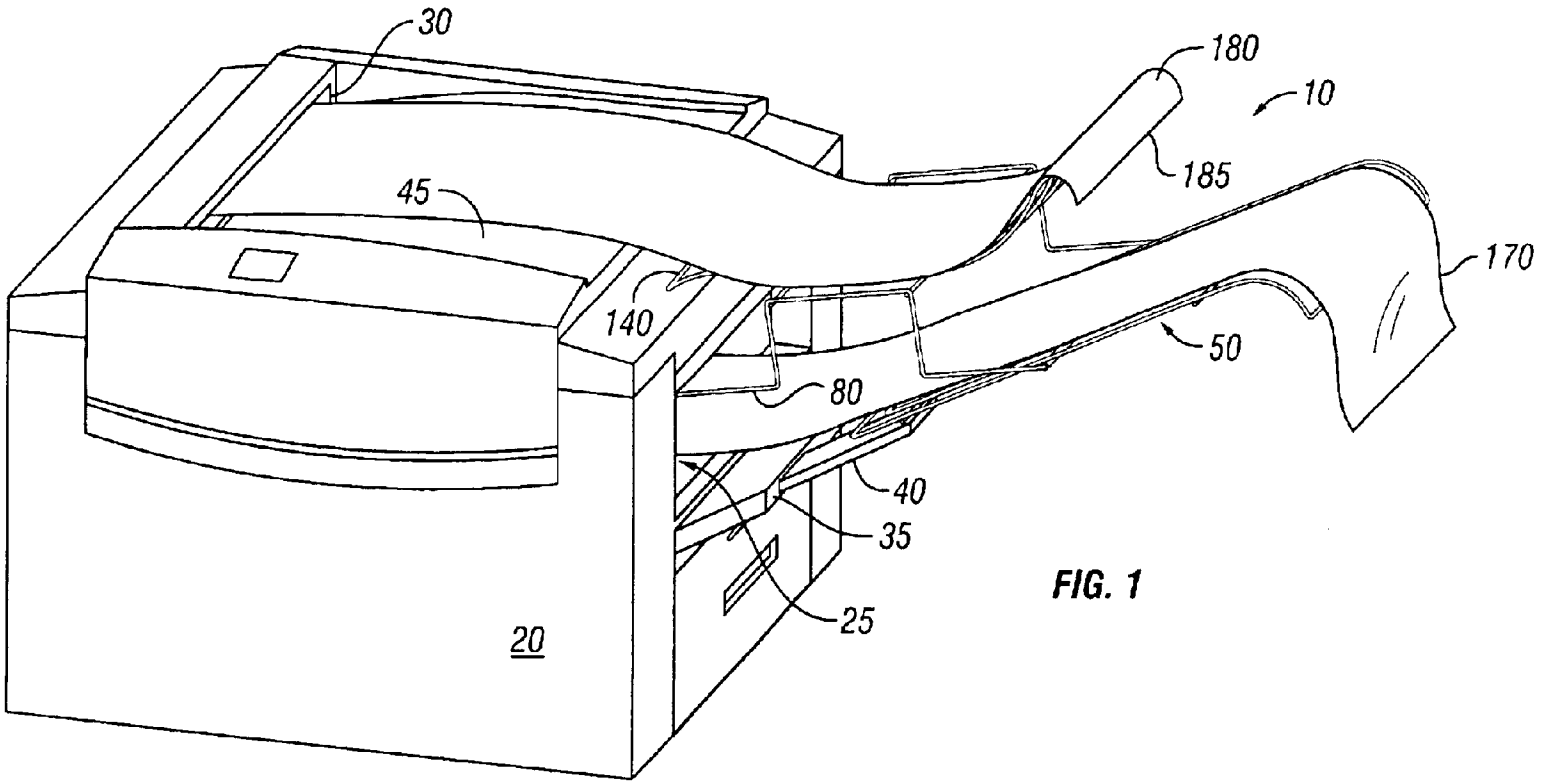
FIG. 1 is an upper side perspective view of a combination input and output tray assembly of a preferred embodiment of the present invention attached to a printing device, with elongated sheets of printing media disposed on both the input tray and the output tray.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the combination input and output tray assembly and designated parts thereof. The terminology includes the words above specifically mentioned, derivatives thereof and words of similar import.

As used herein, the word "elongated" as applied to sheets of printing media means a sheet which is longer than 14 inches for sheet widths equal to or less than 8½ inches and longer than 17 inches for sheets of paper over 8½ inches in width.

Also as used herein, the term "printing media" refers to substrates such as paper or transparency film onto which images are deposited by a printing device.

Referring to the figures, wherein like numerals are used to indicate like elements throughout, there is shown in FIGS. 1–7, a preferred embodiment of a combination input and output tray assembly, generally designated 10, in accordance with the present invention.

Figure 2:
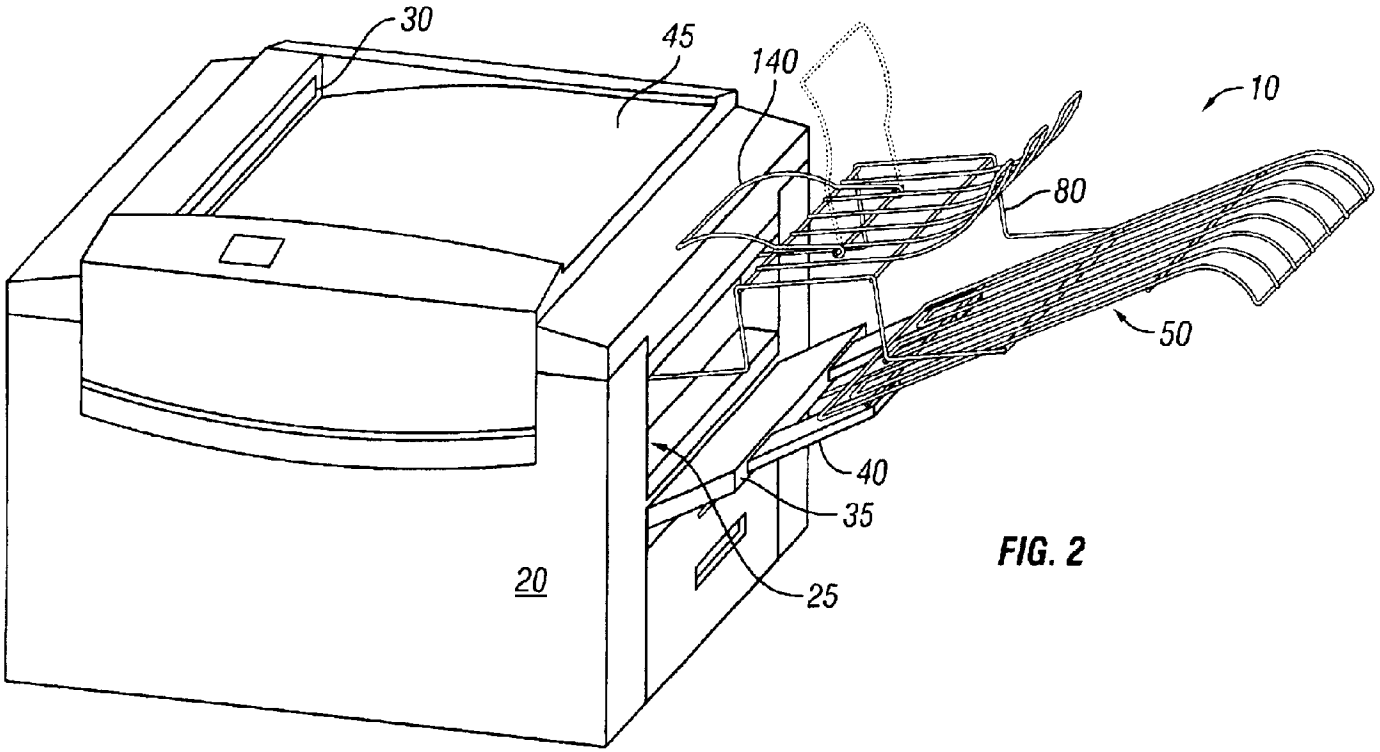
FIG. 2 is an upper side perspective view of the combination input and output tray assembly of FIG. 1, shown without elongated sheets of printing media disposed on either the input or the output tray.
Figure 3:
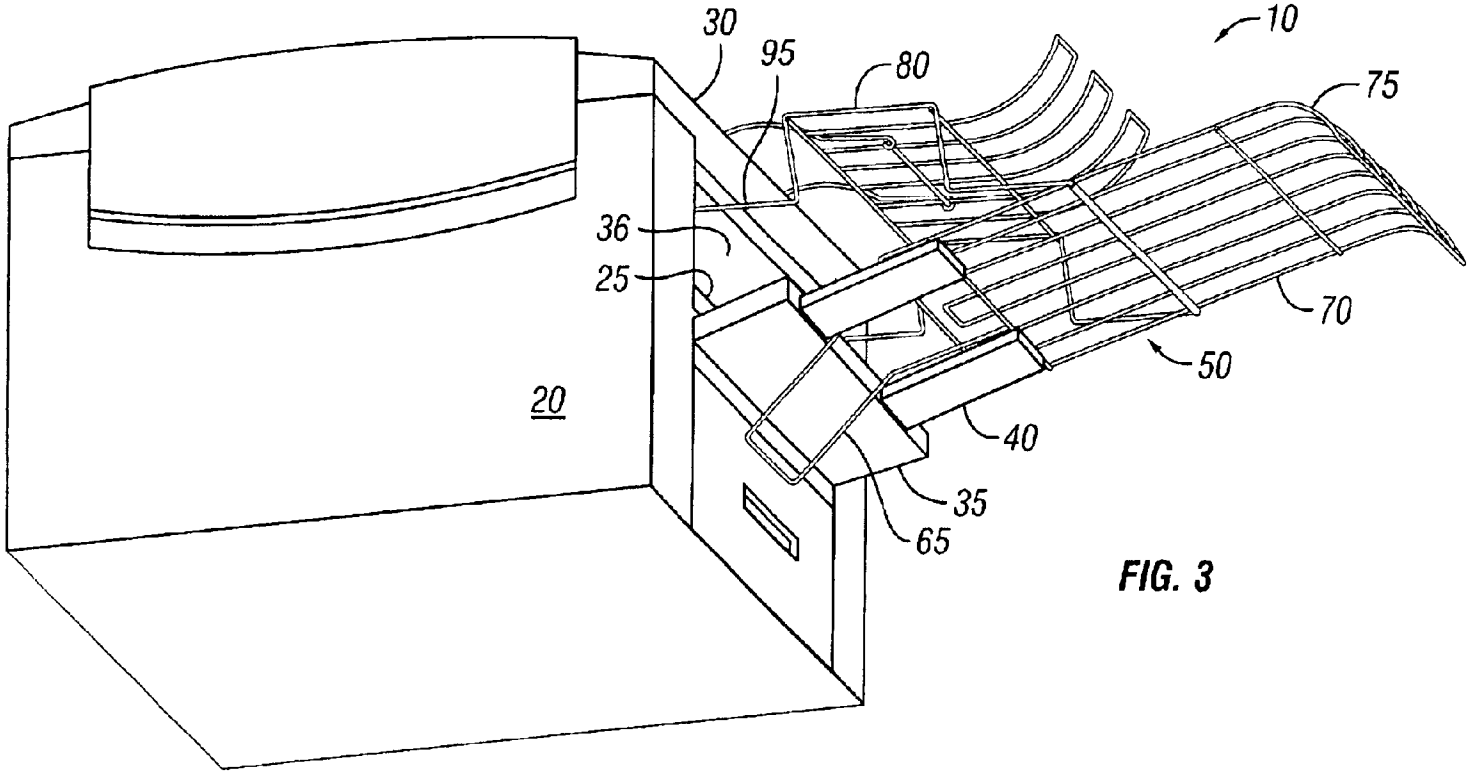
FIG. 3 is a lower side perspective view of the combination input and output tray assembly of FIG. 2.

As is illustrated in FIGS. 1–4, the combination input and output tray assembly 10 comprises an input tray 50, an output tray 80 and an output bridge 140. The combination input and output tray assembly 10 removably attaches to a printing device 20. The printing device 20 includes an input port 25 for receiving sheets of media to be printed upon. The printing device 20 further includes an output port 30 from which sheets of media are delivered following the printing operation. Elongated sheets of printing media 170 and 180 are shown disposed on the input tray 50 and on the output tray 80, respectively, in FIG. 1. In FIGS. 2 and 3, the media sheets 170 and 180 are removed to improve clarity of FIGS. 2 and 3.

Referring now particularly to FIG. 3, the arrangement of a printing device input port access door 35 and printing device access door extension wings 40 in relation to the input tray 50 when the combination input and output tray assembly 10 is attached to a printing device 20 is illustrated. The printing device 20 illustrated includes a door 35 pivotally attached to a side of the printing device 20. The door 35 provides access to the input port 25. In a fully open position, the door 35 is pivoted approximately 70 degrees from a vertical closed position. In the fully open position, the door 35 also serves as a tray to hold sheets of printing media in a position whereby the sheets are typically individually and manually fed into the input port 25. A pair of extension wings 40 are hingeably attached to the door 35 to provide support and alignment for longer sheets of printing media.

In the assembled configuration, a first planar portion 65 of the input tray 50 fits beneath the door 35. A central planar portion 70 of the input tray 50 fits on top of the door extension wings 40. Thus, an interfit between the input tray 50, the access door 35 and the extension wings 40 is created, preventing the input tray 50 from either sliding forward toward the printing device 20 or from rotating in a direction wherein the central planar portion 70 would pivot downwardly. Furthermore, the attachment of the output tray 80 to the printing device 20 is also illustrated. Front legs 96 forming a first planar portion 95 of the output tray 80 terminate in a first pair of hooks 130 (see FIG. 6). The first pair of hooks 130 fit within slots (not shown) formed in the sidewalls (not shown) of a recess 36 formed within the opening for the access door 35.

Figure 4:
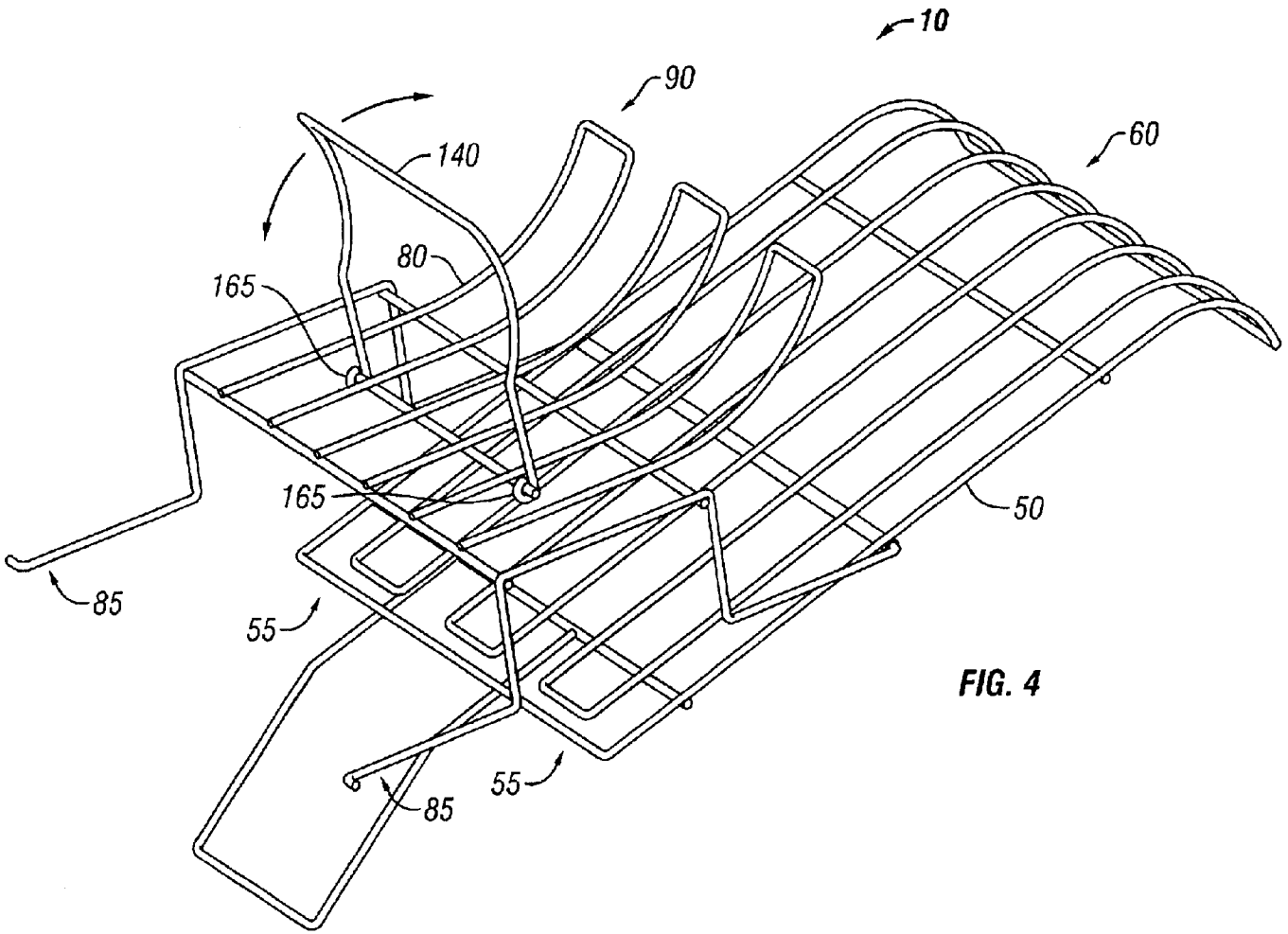
FIG. 4 is an upper side perspective view of the combination input and output tray assembly of FIG. 2, shown detached from the printing device.

Referring now to FIG. 4, the combination input and output tray assembly 10 is shown detached from the printing device 20. The input tray 50 is shown to have a first end 55 and a second end 60. The output tray 80 is similarly shown to have a first end 85 and a second end 90. The output tray 80 includes a pair of rear legs 101 which terminate in a second pair of hooks 135 (see also FIG. 6). As described later herein, the second pair of hooks 135 assemble with the input tray 50 to interconnect the input and output trays 50, 80.

The output bridge 140 is shown to be pivotally attached to the output tray 80. In the embodiment illustrated, the output bridge 140 is a U-shaped structure having two legs 142 (see FIG. 7). Each leg 142 terminates in an attachment loop 165 at the second end 90. The output bridge 140 is pivotally attached to the output tray 80 using the attachment loops 165. When the combination input and output tray assembly 10 is attached to the printing device 20, the output bridge 140 may be pivoted toward the printing device 20 to ensure that the output sheet 180 is properly directed onto the output tray 80. Alternatively, when the combination input and output tray 10 is detached from the printing device 20 in the process of being installed onto or detached from the printing device 20, the output bridge 140 may be pivoted away from the printing device 20 to overlay the output tray 80 in a more convenient position.

Figure 5:
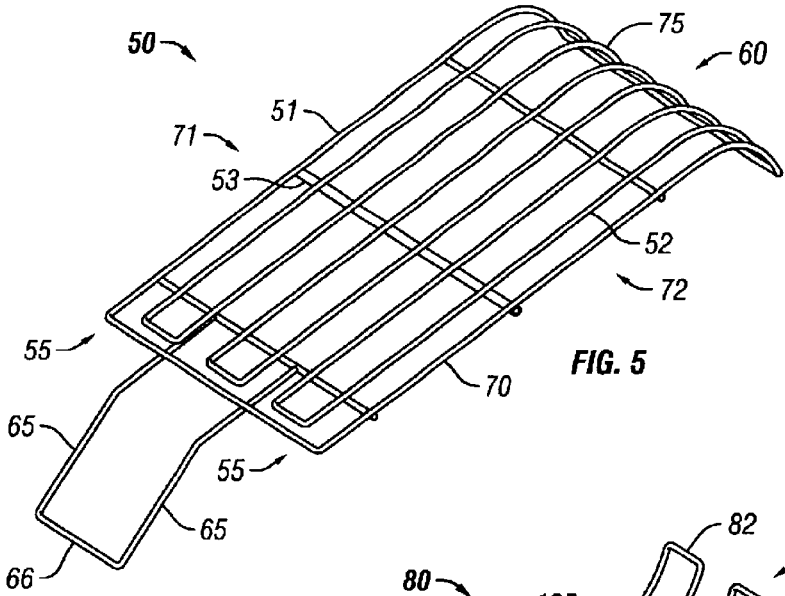
FIG. 5 is an upper side perspective view of an output tray of the combination input and output tray assembly of FIG. 2.

Referring now to FIG. 5, the input tray 50 is shown. In the embodiment shown, the input tray 50 is formed as a frame 51 structure formed from wire elements 52. A hollow tube element 53 is oriented traverse to opposing side edges 71, 72 of the input tray 50. The input tray 50 has first end 55 and second end 60. The first planar portion 65 which fits beneath the access door 35 of the printing device 20 is formed by a U-shaped wire loop 66. The central planar portion 70 connects to the first planar portion 65, and terminates at the second end 60 in a curved portion 75.

Figure 6:
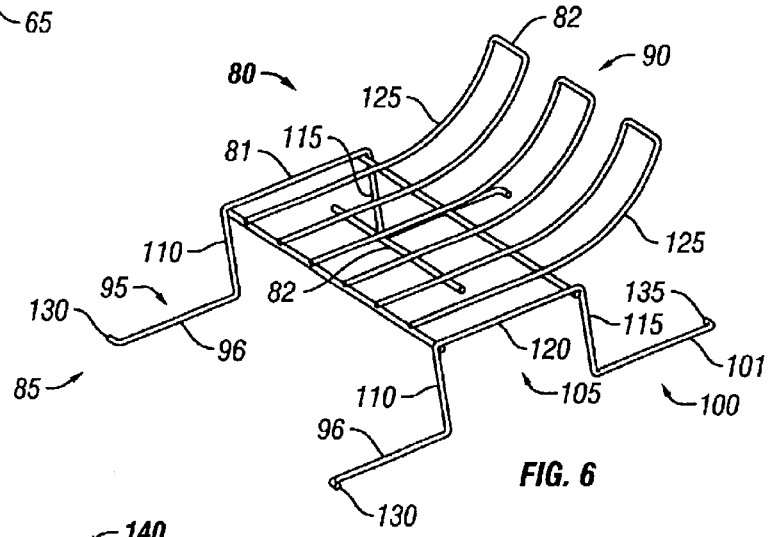
FIG. 6 is an upper side perspective view of an input tray of the combination input and output tray assembly of FIG. 2.

Referring now to FIG. 6, the output tray 80 is shown. Like the input tray 50, a preferred embodiment of the output tray 80 is a frame 81 formed by a plurality of wire elements 82. The two front legs 96 form the first planar portion 95 at the first end 85. The front legs 96 terminate in the pair of hooks 130 which are preferably used to releasably attach the output tray 50 to the printing device 20. A U-shaped central portion 105 is formed by a first plurality of legs 110, a second plurality of legs 115 and a third planar portion 120 connecting the first and second plurality of legs 110, 115. The pair of rear legs 101 form the second planar portion 100. The rear legs 101 terminate in the second pair of hooks 135.

Figure 7:
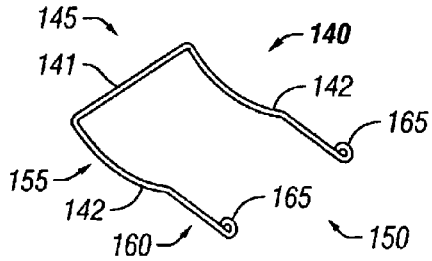
FIG. 7 is an upper side perspective view of a output bridge of the combination input and output tray assembly of FIG. 2.

Referring now to FIG. 7, the output bridge 140 is illustrated. A preferred embodiment of the output bridge 140 is a wire element 141 bent in a U-shaped configuration. The output bridge 140 has a first end 145 and a second end 150. The output bridge 140 has a first curved portion 155 and a second planar portion 160 both formed by two legs 142. The legs 142 each terminate in a loop 165. The loops 165 allow the output bridge 140 to be pivotally attached to the output tray 80.

In operation, the output tray 80 is assembled to the input tray 50 by deflecting rear legs 101 toward the outer edges of the output tray 80 such that the pair of hooks 135 can be inserted into the ends of the tube 53 of the input tray. The output tray 80 is thus pivotally attached to the input tray 50. As noted above, the output bridge 140 is pivotally attached to the output tray 80 via wire loops 165. The combination input and output tray assembly 10 thus formed is attached to the printing device 20 as described above and as illustrated in FIG. 3. Elongated sheets 170 of printing media are loaded onto the input tray 50, ready to be fed into the input port 25. After being fed into the printing device 20 via input port 25, printed sheets 180 are discharged via the output port 30, a leading edge 185 first moving across a standard output tray 45 disposed within a top portion of the printing device 20, then, if the output sheet 180 is of sufficient length, across the output bridge 140, across the third planar portion 120 of the output tray 80, and then up and over the curved portion 125 of the output tray 80.

The embodiment illustrated in FIG. 3 indicates one arrangement by which the present invention may be attached to a printing device 20. From this disclosure, it would be obvious to one of ordinary skill in the art that other attachment arrangements exist. For example, the output tray 80 could be provided with at least one protrusion which would fit within a mating receptacle in a snap fit arrangement. The output tray 80 could be fastened to the printing device 20 using mechanical fasteners such as screws. The input tray 50 could be allowed simply to rest against a side of the printing device 20, as an alternative to the inter-fitting arrangement of the input tray 50, the input port access door 35 and the access door extensions 40 illustrated in FIG. 3.

The wire frames 51, 81 and 141 are preferably fabricated from steel wires which are suitably bent and assembled using welding techniques well known to those of ordinary skill in the art. From this disclosure, it would be obvious to one of ordinary skill in the art that alternatively the input tray 50, output tray 80 and output bridge 140 could be formed as a solid structure, and formed from a variety of materials including polymeric materials or metal using a variety of conventional fabrication techniques including injection molding, extrusion, stamping, welding and soldering. From this disclosure it would be further obvious to one of ordinary skill in the art that the relative proportions of the various components of the present invention could be varied without departing from the scope and spirit of the invention.

A combination input and output tray assembly 10 is thus disclosed which allows elongated input sheets 170 of printing media to be received upon and supported by an input tray 50, fed into an input port 25 of a printing device 20 and output sheets 180 of the elongated printing media to be received by an output tray 80 from an output port 30 of the printing device 20.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed:

1. A combination input and output tray assembly for supplying and receiving elongated sheets of media for use with a printing device, the printing device having an input port for receiving the elongated sheets of media and also having an output port for discharging the elongated sheets of media, the combined input and output tray assembly comprising:

a first tray formed by a first wire frame and generally aligned with the input port, the first tray for receiving and supporting at least one elongated sheet of media to be received into the input port in a first direction;

a second tray formed by a second wire frame and overlying and connected to the first tray, the second tray being generally aligned with the output port, so that an elongated sheet of media discharged from the output port in a direction generally opposite to the first direction is received on and supported by the second tray;

an output bridge, wherein the output bridge guides a leading edge of the elongated sheet of media from the printing device to the output tray, and at least one structural member of the tray assembly being attached to the printing device.

2. The combination input and output tray assembly of claim 1, wherein the output bridge is formed by a third wire frame.

3. The combination input and output tray assembly of claim 1, wherein the output bridge is pivotally attached to the second tray.

4. A combination input and output tray assembly for supplying and receiving elongated sheets of media for use with a printing device, the printing device having an input port for receiving the elongated sheets of media and also having an output port for discharging the elongated sheets of media, the combined input and output tray assembly comprising:

a first tray fanned by a first wire frame and generally aligned with me input port, the first tray for receiving and supporting at least one elongated sheet of media to be received into the input port in a first direction;

a second tray formed by a second wire frame and overlying and connected to the first tray, the second tray being generally aligned with the output port, so that an elongated sheet of media discharged from the output port in a direction generally opposite to the first direction is received on and supported by the second tray; and at least one structural member of the tray assembly being attached to the printing device, wherein the at least one structural member is at least one front leg element of the second wire frame, the front leg element terminating in a hook which fits within a slot in the printing device.

5. A combination input and output tray for supplying elongated sheets of media to a printing device and receiving the elongated sheets of media from the printing device, the printing device having an input port for receiving sheets of media, an output port for discharging the sheets of media, and an input port access door having extension members pivotally connected to the printing device the combination input and output tray comprising:

a first structure forming an input tray;

a second structure farming an output tray which is attached to the input tray;

a third structure forming an output bridge, the output bridge being pivotally attached to the output tray, wherein when the input port access door is in an open position, and the combined input and output tray is assembled with the printing device, a first end of the input tray is below the input port access door, a central portion of the input tray is on top of the extension members, and a first end of the output tray is attached to the printing device;

wherein the elongated sheets of media to be fed into the input port in a first direction rest upon the printing device input door and upon the central portion of the media input tray and, if of sufficient length, upon a second end of the media input tray, and wherein the elongated sheets of media being delivered from the output port in a second direction generally opposite the first direction are guided by the output bridge onto a central planar portion of the output tray and, if of sufficient length, onto a second end of the output tray.

6. The combination input and output tray of claim 5, wherein the input tray is formed by a wire frame.

7. The combination input and output tray of claim 6, wherein the input tray has a first generally planar portion defining a first plane at a first end, a second generally planar central portion defining a second plane, and a curved portion at a second end.

8. The combination input and output tray of claim 5, wherein the output tray is formed by a wire frame.

9. The combination input and output tray of claim 7, wherein the output tray has a first generally planar portion defining a first plane at a first end, a second generally planar portion lying generally within the first plane at a second end, a generally U-shaped central portion connecting the first and second planar portions, a first plurality and a second plurality of legs of the central portion extending at approximately 90 degrees from the first plane and a third generally planar portion defining a second plane connecting the first and second plurality of legs, and a curved portion extending upwardly from the third planar portion in the direction of the second end of the output tray.

10. The combination input and output tray assembly of claim 5, wherein the output bridge is formed by a wire frame.

11. The combination input and output tray assembly of claim 5, wherein the output bridge is generally U-shaped and has a curved first portion at a first end, and a second generally planar portion formed by first and second legs at a second end, the first and second legs terminating in loops at the second end, the output bridge being pivotally attached to the output tray by the loops.

* * * * *